US010588481B2

(12) United States Patent
Bussell

(10) Patent No.: US 10,588,481 B2
(45) Date of Patent: Mar. 17, 2020

(54) DISHWASHER TAG SYSTEM HAVING DISSOLVABLE COMPONENT FOR INDICATING COMPLETION OF A WASH AND CLEAN CYCLE WHEN PLACED WITHIN A RACK OF A DISHWASHER

(71) Applicant: Jeffrey A. Bussell, West Bloomfield, MI (US)

(72) Inventor: Jeffrey A. Bussell, West Bloomfield, MI (US)

( * ) Notice: Subject to any disclaimer, the term of this patent is extended or adjusted under 35 U.S.C. 154(b) by 0 days.

(21) Appl. No.: 16/595,762

(22) Filed: Oct. 8, 2019

(65) Prior Publication Data

US 2020/0029782 A1 Jan. 30, 2020

Related U.S. Application Data

(63) Continuation-in-part of application No. 16/394,036, filed on Apr. 25, 2019.

(60) Provisional application No. 62/682,433, filed on Jun. 8, 2018.

(51) Int. Cl.

| | |
|---|---|
| ***G09F 3/00*** | (2006.01) |
| ***B42D 25/00*** | (2014.01) |
| ***A47L 15/42*** | (2006.01) |

(52) U.S. Cl.

CPC ..... *A47L 15/4295* (2013.01); *B42D 25/00* (2014.10); *G09F 3/0291* (2013.01)

(58) Field of Classification Search

CPC ..... G09F 3/0291; B42D 2035/34; A47L 15/4295

USPC ..... 283/81, 96, 97, 901

See application file for complete search history.

(56) References Cited

U.S. PATENT DOCUMENTS

| | | | | |
|---|---|---|---|---|
| 2,093,397 | A | 9/1937 | McCulloch | |
| 2,223,106 | A * | 11/1940 | Humphner | G09F 3/0292 283/81 |
| 3,989,279 | A | 11/1976 | Levy | |
| 6,463,940 | B1 | 10/2002 | Thomas et al. | |
| 7,437,213 | B2 | 10/2008 | Batcher | |
| 8,037,545 | B2 * | 10/2011 | McLaughlin | G09F 21/02 2/69 |
| 8,529,705 | B2 | 9/2013 | Rolek | |
| 8,696,827 | B2 | 4/2014 | Ashrafzadeh et al. | |
| 2017/0270833 | A1 | 9/2017 | Dill et al. | |

FOREIGN PATENT DOCUMENTS

| | | | |
|---|---|---|---|
| CH | 622740 | A5 | 4/1981 |
| GB | 2435640 | A | 9/2007 |

* cited by examiner

*Primary Examiner* — Kyle R Grabowski
(74) *Attorney, Agent, or Firm* — Dinsmore & Shohl LLP

(57) ABSTRACT

A system including a tag for placement within a dishwasher to indicate at least one of a running of a dishwasher run cycle and/or a clean condition of items placed within the dishwasher upon completion of the cycle. A tag body is supported within an interior rack location of the dishwasher so that a surface of the body is visible. A patch of material is formed upon the surface of the tag body and constructed of a dissolvable material. The patch is caused to be dissolved upon activation of a wash cycle of the dishwasher to indicate the clean condition of the items adapted to being placed in the dishwasher.

15 Claims, 3 Drawing Sheets

DISHWASHER TAG SYSTEM HAVING DISSOLVABLE COMPONENT FOR INDICATING COMPLETION OF A WASH AND CLEAN CYCLE WHEN PLACED WITHIN A RACK OF A DISHWASHER

CROSS REFERENCE TO RELATED APPLICATIONS

The present application claims the priority of U.S. Ser. No. 16/394,036 filed Apr. 25, 2019. The '036 application claims the priority of U.S. Ser. No. 62/682,433 filed Jun. 8, 2018.

FIELD OF THE INVENTION

The present invention provides a dishwasher rack attachable tag, such including a dissolvable component which, upon completion of a wash cycle, represents to the user that the dishes are clean.

BACKGROUND OF THE RELEVANT ART

The prior art discloses a variety of monitoring devices for use with a dishwasher cycle. A first example of the smart rack and machine system of Thomas U.S. Pat. No. 6,463,940, in which each type of article is detected and washed according to its own pre-determined condition.

Batcher, U.S. Pat. No. 7,437,213, teaches a method and system for monitoring performance of a warewasher and which includes RFID tags placed into individual washer racks. The tags are in communication with a host computer for monitoring performance.

Other references of note include the dishwasher with imaging device of Ashrafzadeh U.S. Pat. No. 8,696,827, along with the dishwashing machine of Rolek U.S. Pat. No. 8,529,705 which includes a dispenser configured to receive a dishwashing tablet and a sensor operable to identify the dishwashing tablet, with an electronic controller selecting a dishwasher cycle based on the identify of the dishwashing tablet.

Humphner, U.S. Pat. No. 2,223,106, teaches a tax label with a paper base printed thereon in water insoluble ink indicating cancellation, with a water soluble adhesive and light impermeable pigmented layer extending over and concealing the printing, and over which a final print is provided on the pigmented layer.

SUMMARY OF THE PRESENT INVENTION

The present invention discloses a system including a tag for placement within a dishwasher to indicate at least one of a running of a dishwasher run cycle and/or a clean condition of items placed within the dishwasher upon completion of the cycle.

A tag body is supported within an interior rack location of the dishwasher so that a surface of the body is visible. A patch of material is formed upon the surface of the tag body and may be constructed of a dissolvable material. The patch is caused to be dissolved upon activation of a wash cycle of the dishwasher to indicate the clean condition of the items adapted to being placed in the dishwasher.

Additional features include at least one of a notch, aperture or lanyard associated with the body and adapted to securing the body to a projection associated with such as a rack supported in the dishwasher in proximity to the items.

The patch is constructed of a material not limited to any combination of one or more of a dry soap or a gelatinous composition.

The patch can optionally include a first DIRTY indicia placed thereupon and which, upon being dissolved can reveal a second CLEAN indicia. The body can also exhibit a thin planar configuration not limited to a rectangular outline with rounded edges and can also be constructed of a semi-rigid and heat resistant material. The body may also be constructed of a recyclable and/or biodegradable material. The lanyard can further include a looped portion affixed through the notch.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
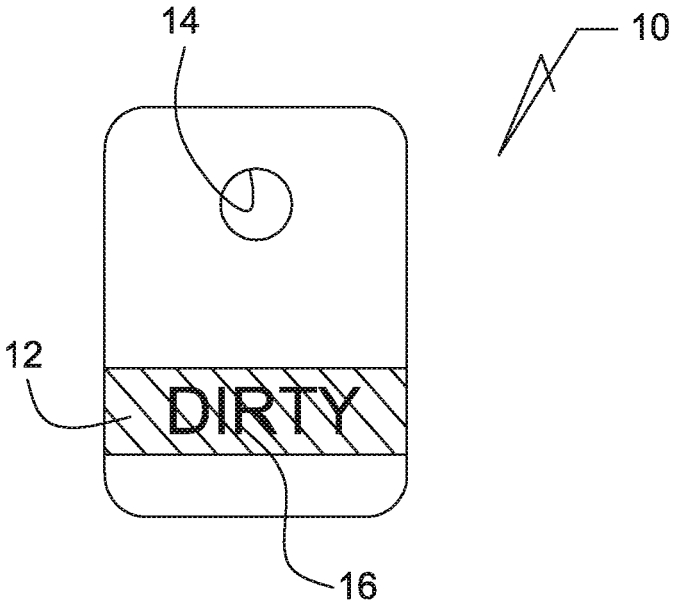
FIG. 1 is an illustration of the dishwasher rack tag in a first pre-use condition in which the patch is present upon the front face of the tag body, a DIRTY or like indicia being integrated into the visible surface of the patch.
Figure 2:
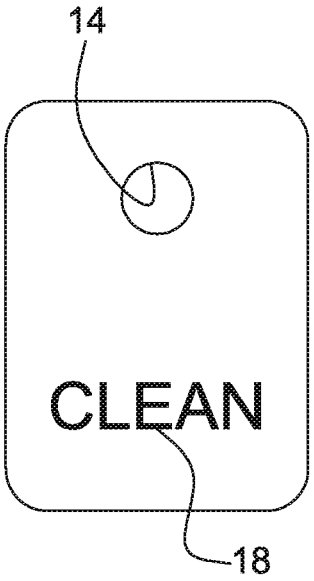
FIG. 2 is a succeeding illustration of the dishwasher rack tag in a second used condition in which the wash/rinse cycles of the dishwasher result in the dissolving of the patch material in order to reveal a further CLEAN or like indicia which is indelibly printed upon the surface of the tag and exposed upon the dissolving of the patch material.

With reference to FIGS. 1-2, the present invention teaches a tag, typically plasticized in construction and as shown at 10, and which incorporates a suitable water/heat activating and dissolving strip component, such further shown at 12 in FIG. 1. The tag 10 is provided as a relatively thin and semi-rigid plastic having heat resistant properties up to a given temperature consistent with the operating temperature of the dishwasher heat cycle.

The tag 10 further is depicted having a rectangular outline with rounded edges and, although not limited to any particular shape, can include a rectangular body with rounded edges and a longest length dimension of approximately 1"-1.25". The tag further includes an interior aperture (see inner perimeter rim 14) for permitting the tag to be mounted to such an upper (or lower) tray of the associated dishwasher, and such as upon an upwardly extending prong or projection of the tray which can include a bulbous or enlarged end for seating through the inner perimeter rim 14 in a resistive attaching fashion. Without limitation, the rim 14 can be substituted by any of a notching in the edge of the tag as well as the use of any type of lanyard or other attachment (see also looped attachment portion in FIG. 4 described below) for supporting the tag in a secure and exposed visible condition upon the dishwasher rack or other interior location.

As again shown in FIG. 1, the patch 12 is formed upon the exposed surface of the tag 10, such as in a strip along its lower portion. The patch 12 without limitation is envisioned to possess a minimum thickness and can be constructed from any material which, when exposed to the wash/heat and rinse cycles, is caused to be dissolved. Without limitation, the material composition of the patch is further envisioned to be partially resistant to the wash cycle, such as to a reasonable degree ensuring that it will not wear away/dissolve instantaneously, but rather will gradually efface in response to the running of the dishwasher cycle and so that it is not dissolved until the cycle has been substantially completed.

In other variants, the patch can be redesigned to wear away (or efface) with or without a heat component, such as based on the water component alone. The material construction of the tag can further be such that it avoids melting during the dishwasher dry cycle.

Additionally, the patch 12 can be desired to dissolve at any rate, such as reasonably quickly without lasting the entire cycle and to denote that the washer was turned on (if not completely run through its entire cycle). By example, and if someone were to interrupt a cycle, the dissolution of the patch would instruct that the washer was running and to prompt the individual to close the door and turn the machine on again.

In this fashion, the pre-wash indicia, see DIRTY at 16 in FIG. 1 is removed along with the patch so that, at FIG. 2, a further underlying indicia (CLEAN at 18 in FIG. 2) is revealed, thereby denoting that the dishwasher has successfully completed the wash cycle and that the dishes and other items contained within are clean.

Without limitation, the material composition of the patch 12 can include any of dry dish soap or other non-toxic/innocuous dissolvable material. Other options for the patch include the provision of a gelatinous undercoat in combination with the dry dish soap or another dry, innocuous material positioned thereupon and which will quickly dissolve during the course of the wash cycle.

Other options can include the patch including a combination of dry soap and a gelatinous material. The tags can also be constructed of any recyclable and/or biodegradable materials with the understanding that they are usually disposed after a given washer cycle.

Figure 3:
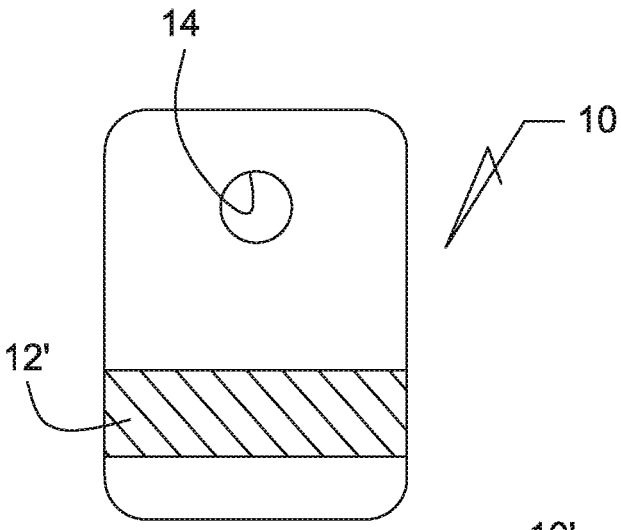
FIG. 3 is a subset variant to FIG. 1 in which no indicia is found on the patch material prior to being put through the dish washer cycle.
Figure 4:
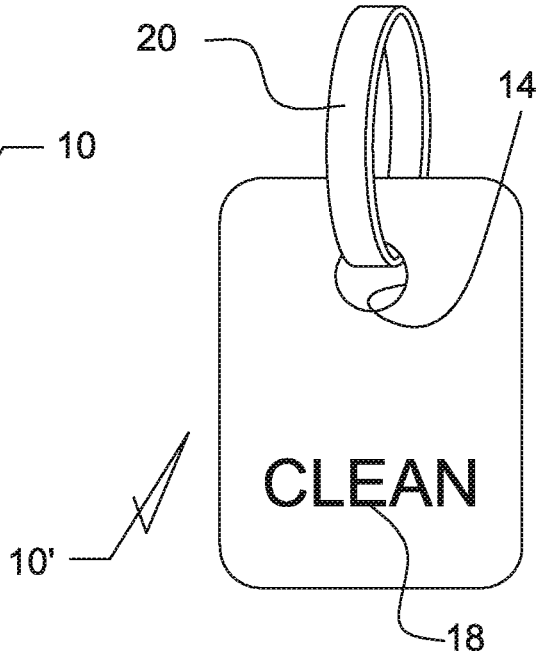
FIG. 4 is an alternate variant to FIG. 1 in which an additional loop material is installed through the aperture rim of the tag, such as in order to better support the tag when secured upon an upward projecting location of a dishwasher supported rack.

With succeeding reference to FIG. 3, a subset variant to FIG. 1 is shown and in which no surface or other identifying indicia is found on a modified patch material, at 12', prior to it being put through the dish washer cycle. FIG. 4 presents an alternate variant of tag 10' as compared to that depicted in FIG. 1, and in which an additional loop material, see at 20, is installed through the aperture rim 14 of the tag, such as in order to better support the tag when secured upon an upward projecting location of a dishwasher supported rack (at 22 in reference to FIGS. 5-8).

Although not shown, it is understood that the conventional supporting racks (typically one upper and one lower) contained within the dishwasher each include multiple upward projections upon which the tag can be supported at a location to render it easy to view by a user upon opening the dishwasher door and, if necessary, pulling the rack outwardly from the washer interior. It is also envisioned that a potentially unlimited number of options exist for supporting the tag within the dishwasher rack and which are not limited to engaging the rack via the inner rim defining aperture 14 or the looped lanyard 20.

Figure 5:
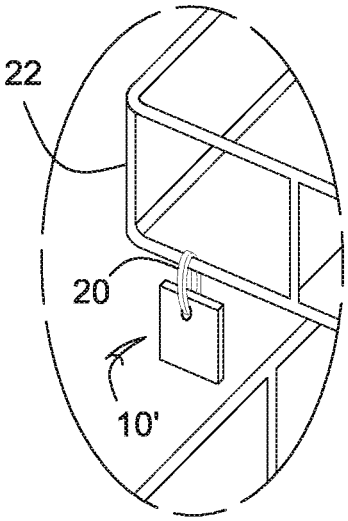
FIG. 5 is an enlarged sectional illustration of a lanyard variant of the tag supported upon a dishwasher rack according to the present invention.
Figure 6:
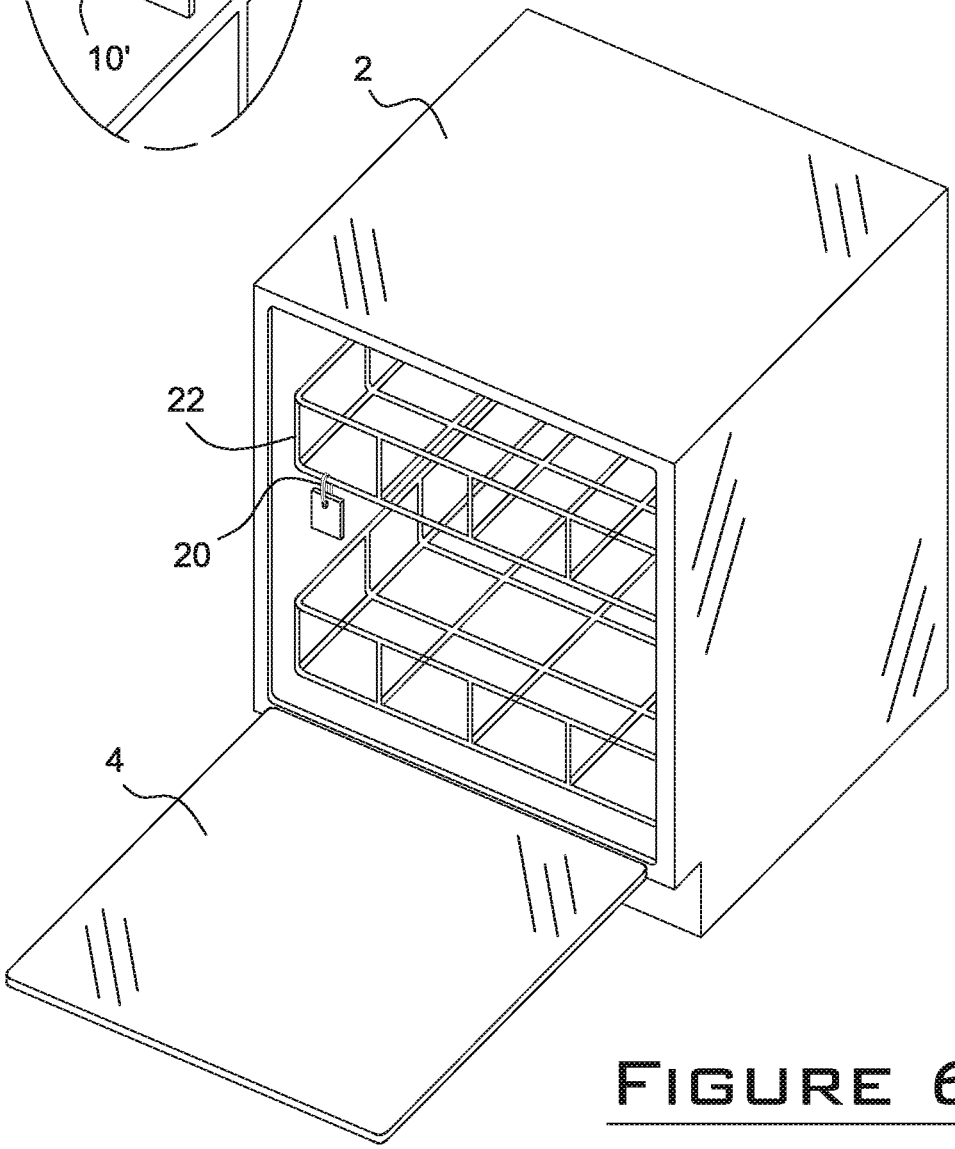
FIG. 6 is a perspective view of the dishwasher rack supported lanyard and tag of FIG. 5 arranged within a dishwasher as part of the system of the present invention.

FIG. 5 is an enlarged sectional illustration of a lanyard variant of the tag 10', such as depicted in FIG. 4, supported upon a dishwasher rack 22 according to the system of the present invention. FIG. 6 is a perspective view of the dishwasher rack supported lanyard and tag of FIG. 5 arranged within a dishwasher, see as generally shown at 2 and including a front loading door 4 as part of the system of the present invention.

The present system includes a tag 10 for placement within the rack in turn supported in the dishwasher 2 to indicate at least one of a running of a dishwasher run cycle and/or a clean condition of items placed within the dishwasher upon completion of the cycle. As previously described, the system includes a tag body 10 supported within an interior rack location of the dishwasher so that a surface of the body is visible.

A patch of material 12 (again as optionally shown in FIG. 1) is formed upon the surface of the tag body and is constructed of a dissolvable material. Upon the patch being caused to be dissolved upon activation of a wash cycle of the dishwasher, the result is to indicate the clean condition of the items adapted to being placed in the dishwasher. Without limitation, the present invention contemplates the providing of a CLEAN indicia 18 or, alternatively, no indicia upon completion of the wash cycle.

Figure 7:
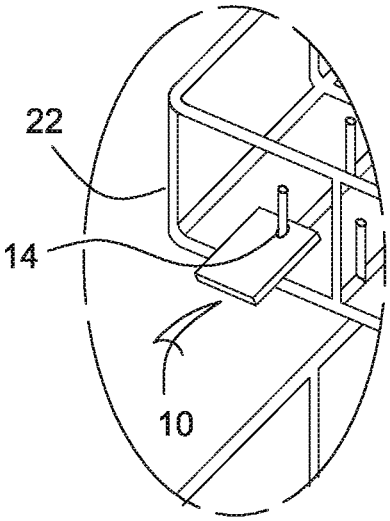
FIG. 7 is an enlarged sectional view of a tag with aperture (non-lanyard) variant supported upon a dishwasher rack according to the present invention.
Figure 8:
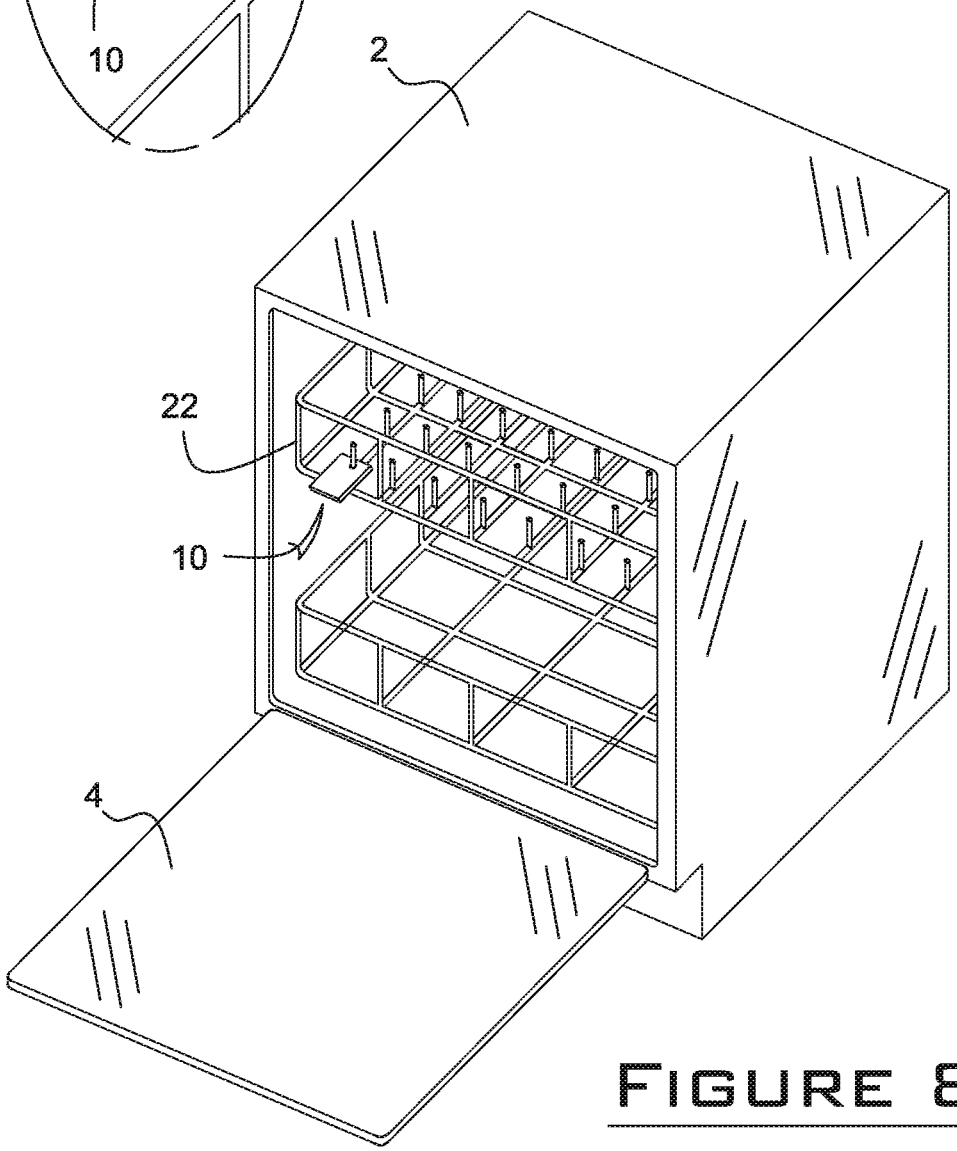
FIG. 8 is a perspective view of the dishwasher rack supported tag of FIG. 7 arranged within a dishwasher as part of the system of the present invention.

FIG. 7 is an enlarged sectional view of a tag with aperture (non-lanyard) variant 10 supported upon a dishwasher rack according to the present invention. FIG. 8 is a perspective view of the dishwasher rack supported tag of FIG. 7 arranged within a dishwasher, again as part of the system of the present invention.

Having described my invention, other and additional preferred embodiments will become apparent to those skilled in the art to which it pertains, and without deviating from the scope of the appended claims. This can include the body being constructed of a recyclable and potentially biodegradable material.

I claim:

1. A system including a tag for placement within a dishwasher to indicate at least one of a running of a dishwasher run cycle and/or a clean condition of items placed within the dishwasher upon completion of the cycle, said system comprising:

a dishwasher; a tag body consisting of a thin planar polygon supported within an interior rack location of the dishwasher so that a surface of the body is visible;

a patch of material formed upon the surface of said tag body and constructed of a dissolvable material; and said patch being caused to be dissolved upon activation of a wash cycle of the dishwasher to indicate the clean condition of the items adapted to being placed in the dishwasher.

2. The system of claim 1, further comprising at least one of a notch, aperture or lanyard associated with said tag body and adapted to securing said body to a projection within the dishwasher in proximity to the items.

3. The system of claim 2, said lanyard further comprising a looped portion affixed through said notch.

4. The system of claim 1, said patch being constructed of a combination of one or more of a dry soap or a gelatinous composition.

5. The system of claim 1, a first DIRTY indicia placed upon said dissolvable patch, a second CLEAN indicia printed upon the body and, upon dissolving of the patch and DIRTY indicia, the CLEAN indicia being subsequently revealed.

6. The system of claim 1, said tag body having rounded edges.

7. The system of claim 6, said tag body being constructed of a semi-rigid and heat resistant material.

8. The system of claim 1, said tag body being constructed of a recyclable and/or biodegradable material.

9. A system including a tag for placement within a dishwasher to indicate at least one of a running of a dishwasher run cycle and/or a clean condition of items placed within the dishwasher upon completion of the cycle, said tag constructed of any of a biodegradable or recyclable material and said system comprising:

a dishwasher; a tag body consisting of a thin planar polygon constructed of a semi-rigid and heat resistant material and supported within an interior rack location of the dishwasher so that a surface of the tag body is visible;

a notch formed through an interior location of the tag body;

a patch of material formed upon the surface of the tag body and constructed of a dissolvable material; and said patch being caused to be dissolved upon activation of a wash cycle of the dishwasher to indicate the clean condition of the items adapted to being placed in the dishwasher.

10. The system of claim 9, said patch being constructed of a combination of one or more of a dry soap or a gelatinous composition.

11. The system of claim 9, a first DIRTY indicia placed upon said dissolvable patch, a second CLEAN indicia printed upon the body and, upon dissolving of the patch and DIRTY indicia, the CLEAN indicia being subsequently revealed.

12. The system of claim 9, the tag body having rounded edges.

13. The system of claim 9, further comprising a looped lanyard portion affixed through said notch.

14. A system including a tag for placement within a dishwasher to indicate at least one of a running of a dishwasher run cycle and/or a clean condition of items placed within the dishwasher upon completion of the cycle, said tag constructed of any of a biodegradable or recyclable material and said system comprising:

a dishwasher; a tag body consisting of a thin planar polygon constructed of a semi-rigid and heat resistant material and supported within an interior rack location of the dishwasher so that a surface of the tag body is visible;

a notch formed through an interior location of the tag body, a looped lanyard portion affixed through said notch; and a patch of material formed upon the surface of said body and constructed of a dissolvable material, said patch being constructed of a combination of one or more of a dry soap or a gelatinous composition; and a first indicia placed upon said dissolvable patch and indicating a dirty pre-washed condition within the dishwasher, a second indicia printed upon the body and, upon dissolving of the patch being subsequently revealed to indicate completion of a wash cycle of the dishwasher and to indicate the clean condition of the items adapted to being placed in the dishwasher.

15. The system of claim 14, the tag body having rounded edges.

* * * * *